US011647816B2

(12) United States Patent
Allbright

(10) Patent No.: US 11,647,816 B2
(45) Date of Patent: May 16, 2023

(54) CLASP MECHANISM TO ENABLE CONCEALMENT AND USE BY THOSE WITH LIMITED DEXTERITY

(71) Applicant: Elizabeth Allbright, Auburn, CA (US)

(72) Inventor: Elizabeth Allbright, Auburn, CA (US)

( * ) Notice: Subject to any disclaimer, the term of this patent is extended or adjusted under 35 U.S.C. 154(b) by 0 days.

(21) Appl. No.: 17/705,294

(22) Filed: Mar. 26, 2022

(65) Prior Publication Data

US 2022/0304429 A1 Sep. 29, 2022

Related U.S. Application Data

(60) Provisional application No. 63/166,383, filed on Mar. 26, 2021.

(51) Int. Cl.
*A44C 5/20* (2006.01)

(52) U.S. Cl.
CPC ..... *A44C 5/2028* (2013.01)

(58) Field of Classification Search
CPC ..... A44C 5/2028
See application file for complete search history.

(56) References Cited

U.S. PATENT DOCUMENTS 845,654 A * 2/1907 Layng ..... F16B 21/165 54/20
869,059 A * 10/1907 Cashmore ..... A44C 5/22 24/574.1
967,486 A * 8/1910 Avery ..... A44C 5/2028 267/74
1,199,690 A * 9/1916 Gillan ..... F16B 5/06 24/581.1
1,381,257 A * 6/1921 Tramer ..... A44C 5/2028 24/653
1,396,588 A * 11/1921 Nittel ..... A44C 5/2028 24/574.1
1,438,264 A * 12/1922 Rygh ..... A44C 5/2028 24/116 R
1,771,427 A * 7/1930 Waterhouse ..... A44C 5/2019 24/906
1,874,632 A * 8/1932 Sanon ..... E05C 19/10 24/600.6
2,015,616 A * 9/1935 Clark ..... A44C 5/2028 24/574.1
2,016,827 A * 10/1935 Bergstrom ..... A44C 5/2052 24/642
2,124,276 A * 7/1938 Steigenberger ..... A44C 5/2028 24/600.6
2,544,516 A * 3/1951 Walters ..... A47H 13/14 248/302

(Continued)

*Primary Examiner* — Jason W San
(74) *Attorney, Agent, or Firm* — Inventive Law Inc.; Jim H. Salter

(57) ABSTRACT

A clasp mechanism is disclosed. Example embodiments are directed to a clasp mechanism comprising: an outer tube; an end cap attached at a top of the outer tube; an inner tube encompassed by the outer tube, the inner tube having a beveled edge at the top; a spring and a plate captured between the end cap and the beveled edge of the inner tube; a slotted end-cap at the bottom of the outer tube; and a hook configured for insertion into a slot of the slotted end-cap, to latch to the beveled edge of the inner tube, and to be held in place by the spring and plate.

20 Claims, 4 Drawing Sheets

(56) References Cited

U.S. PATENT DOCUMENTS 2,571,402 A * 10/1951 Zeeven ..... B66C 1/34 294/82.23
2,981,995 A * 5/1961 Golubics ..... B42F 13/12 411/908
3,002,239 A * 10/1961 Yonemoto ..... A47H 13/06 24/710.3
3,171,183 A * 3/1965 Johnston ..... A44C 5/2028 24/635
3,350,753 A * 11/1967 Hester ..... A44C 5/2028 24/600.7
3,362,201 A * 1/1968 Lachin ..... A44B 15/00 70/459
3,444,595 A * 5/1969 Wachenheimer ..... A47H 13/04 24/716
3,487,512 A * 1/1970 Marosy ..... F16G 11/00 24/DIG. 60
3,540,087 A * 11/1970 Marosy ..... F16B 7/20 24/DIG. 54
3,611,513 A * 10/1971 Hoober et al. ..... A44C 5/2052 24/658
3,917,065 A * 11/1975 Pape ..... A47H 1/00 206/326
4,364,155 A * 12/1982 Synowicki ..... A44C 5/2061 24/574.1
4,411,050 A 10/1983 Couture
4,803,759 A * 2/1989 Kemble ..... F16G 11/101 24/30.5 R
4,924,562 A 5/1990 Pogharian
4,958,420 A * 9/1990 Bunz ..... A44C 5/2028 24/616
4,982,524 A * 1/1991 Vissing ..... A01K 97/24 43/17.2
5,156,430 A * 10/1992 Mori ..... B66C 1/36 294/82.23
5,351,505 A * 10/1994 Febrer ..... A44C 5/2028 63/3.1
5,606,782 A * 3/1997 Patterson ..... F16G 11/101 24/598.5
5,771,843 A * 6/1998 Karlin ..... A01K 1/06 24/635
6,564,851 B1 * 5/2003 Liao ..... A47H 13/01 16/87.4 R
6,668,608 B1 * 12/2003 Derman ..... A44B 15/002 70/456 R
6,883,211 B2 * 4/2005 Hoshino ..... A44C 5/2061 24/663
7,284,773 B2 * 10/2007 Curry ..... H01R 13/639 285/317
7,752,721 B2 * 7/2010 Lin ..... F16B 45/04 24/600.6
D633,171 S * 2/2011 Wastrack ..... D22/134
9,538,735 B1 * 1/2017 Rider ..... A01K 85/00
9,814,285 B1 11/2017 Rider
10,130,147 B2 * 11/2018 Coe ..... A44C 5/2052
10,178,900 B2 1/2019 Izzo
10,729,106 B2 * 8/2020 McConnell ..... A01K 27/005
10,945,494 B1 * 3/2021 Thomsen ..... A44C 5/2076
2009/0300892 A1 * 12/2009 Yurman ..... A44C 5/2052 24/573.11
2011/0185768 A1 8/2011 Pinchuk
2020/0288825 A1 * 9/2020 Ungar Borbon ..... A44C 5/14

* cited by examiner

CLASP MECHANISM TO ENABLE CONCEALMENT AND USE BY THOSE WITH LIMITED DEXTERITY

PRIORITY PATENT APPLICATION

This non-provisional patent application draws priority from U.S. provisional patent application Ser. No. 63/166,383; filed Mar. 26, 2021. This present non-provisional patent application draws priority from the referenced patent application. The entire disclosure of the referenced patent application is considered part of the disclosure of the present application and is hereby incorporated by reference herein in its entirety.

COPYRIGHT

A portion of the disclosure of this patent document contains material that is subject to copyright protection. The copyright owner has no objection to the facsimile reproduction of the patent document or the patent disclosure, as it appears in the Patent and Trademark Office patent files or records, but otherwise reserves all copyright rights whatsoever. The following notice applies to the disclosure provided below and to the drawings that form a part of this document: Copyright 2019-2022 Elizabeth ALLBRIGHT, All Rights Reserved.

TECHNICAL FIELD

This patent application relates to clasp mechanisms according to one embodiment, and more specifically to a clasp mechanism to enable concealment and use by those with limited dexterity.

BACKGROUND

There are many varieties of jewelry clasps on the market. One type of conventional clasp is the "Push-Release Clasp," which is relatively easy to use for those with dexterity issues. The conventional push-release clasp typically has a long tube that another piece slides into for easy latching. The problem with the conventional push-release clasp is that it cannot be concealed inside of a bead, pearl, or any other decorative component. This is because the part of the conventional push-release clasp that is pushed to release would be left obstructed and unusable.

Spring rings, the most common clasps, as well as lobster claws, the second most common, are all difficult to use for those with dexterity issues. These types of clasps support a reasonable amount of weight as long as the jump rings are connected well to the accessory. However, chains can fall apart if the jump ring is not well-connected to the accessory. Another issue with these types of clasps is their appearance when attempting to use multiple clasps to create a versatile piece, e.g., one that can change based on the wearer's desire. Using these conventional types of clasps for creating multiple strands that can be added or removed quickly creates a look that is crowded and inelegant.

Magnetic clasps come in a few varieties and solve the dexterity issue. However, magnetic clasps are not recommended for bracelets; because, the magnets can be drawn to any metals with which the wearer may come into contact during typical activity. Newer designs of the magnetic clasp allow for the support of heavier attachments by changing the orientation of the magnets and adding a small pin on one side that fits into a hole on the opposite side.

There is a conventional clasp that works like a standard garment snap, with the socket side of the snap being the round spring type into which the closed stub part is pressed. This type of clasp is for use only with lightweight jewelry and the clasp is difficult to conceal without losing functionality.

Box clasps are well suited for multiple strands of chains or beads, and the extra latch can provide added security for heavier or more valuable pieces. Some box clasps are quite beautiful and, depending on the design of the accessory, may be the right choice for the wearer, as they can be useful for those with dexterity issues. Box clasps can add to the general design of a piece as there are many varieties from which to choose. Box clasps can be partially concealed; however, the security of the extra side latch of the box clasp is lost when the clasp is concealed.

Thus, existing clasp mechanisms fail to provide a clasp mechanism enabling concealment, security, and use by those with limited dexterity.

BRIEF DESCRIPTION OF THE DRAWINGS

The various embodiments are illustrated by way of example, and not by way of limitation, in the figures of the accompanying drawings in which.

DETAILED DESCRIPTION

Figure 1:
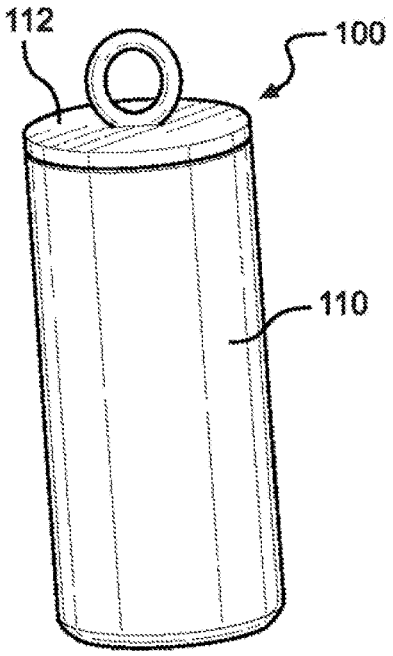
FIG. 1 illustrates the clasp of an example embodiment.

In the following description, for purposes of explanation, numerous specific details are set forth in order to provide a thorough understanding of the various embodiments. It will be evident, however, to one of ordinary skill in the art that the various embodiments may be practiced without these specific details.

This patent application relates to clasp mechanisms according to one embodiment, and more specifically to a clasp mechanism to enable concealment and use by those with limited dexterity. The various example embodiments are described below and included in the drawings included herewith.

One important failure of the conventional clasps described above is that they cannot be inserted into a bead, large stone, or other decorative components to conceal the tube such that—when the clasp is connected, there is only the smallest indication of where the connection occurs. Another important failure of the conventional clasps described above is the inability of the conventional clasps to elegantly provide multiple options of wearability without creating a messy cluster of clasps at the connecting point in the design of the overall piece of jewelry.

As described in detail herein for various example embodiments, my design is simple to use by even those with dexterity issues. Additionally, my design enables the clasp to be inserted into a bead, large stone, or other decorative components to conceal the tube such that-when the clasp is connected, there is only the smallest indication of where the connection occurs. Moreover, my design can elegantly provide multiple options of wearability without creating a messy cluster of clasps at the connecting point in the design of the overall piece of jewelry. These features of my design are described below for various example embodiments.

Referring now to FIGS. 1 through 4, an example embodiment of the clasp 100 includes an outer tube 110 with an end cap 112 at the top, which has an attached ring on one end as shown in FIGS. 1 through 4. The outer tube 110 encompasses an inner tube 120 that is slightly shorter than the outer tube 110. This inner tube 120 has a beveled edge 122 of approximately 35-45 degrees slanting downward from the interior of the inner tube 120 toward the exterior of the inner tube 120 at the end near the top of the outer tube 110.

There is a space provided between the end cap 112 and the top of the inner tube 120 that is wide enough to allow for a four-legged, starfish-shaped spring 116 and a small, round plate 114 to move away from the beveled edge 122 of the inner tube 120 toward the capped end of the outer tube 110. This plate 114 provides the pressure required to hold the inserted hook 130 in place against the beveled edge 122 of the inner tube 120.

Figure 2:
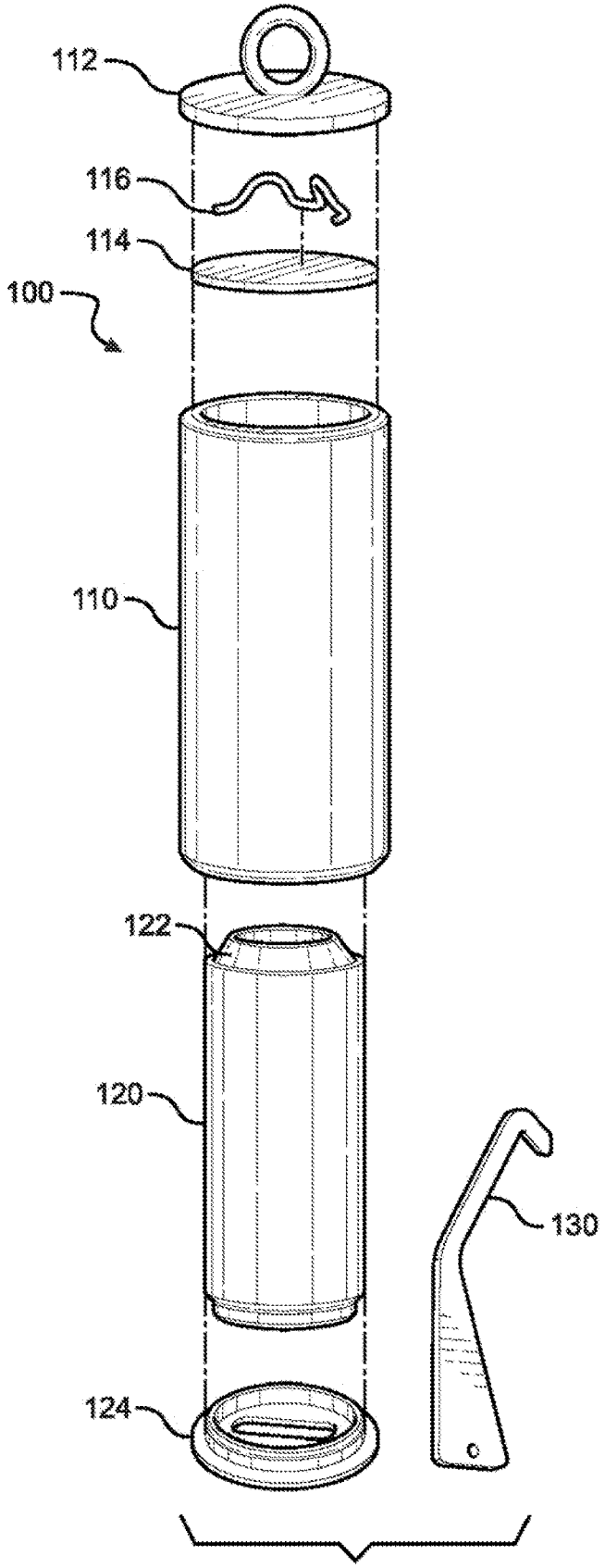
FIGS. 2 and 3 illustrate exploded views of the elements of the clasp of an example embodiment.
Figure 3:
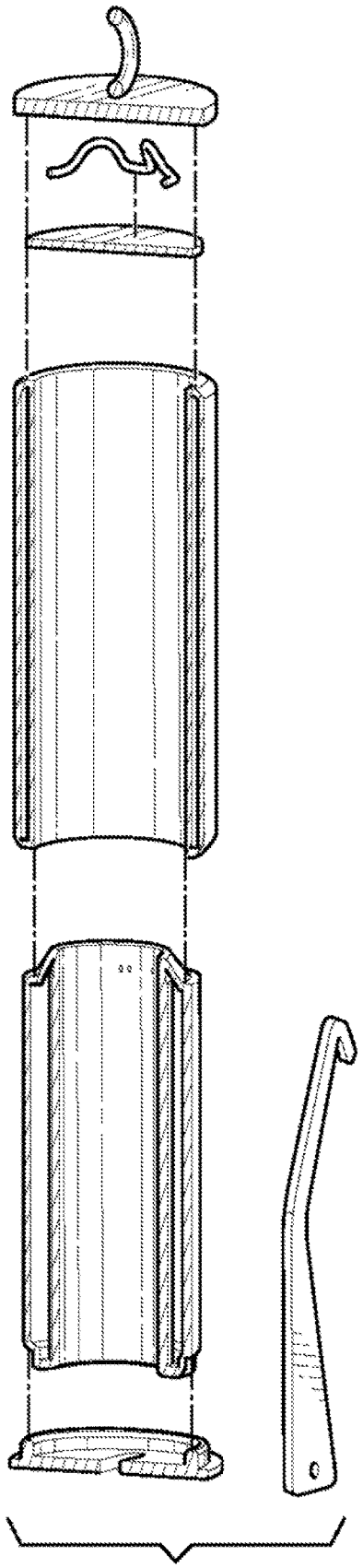
Figure 4:
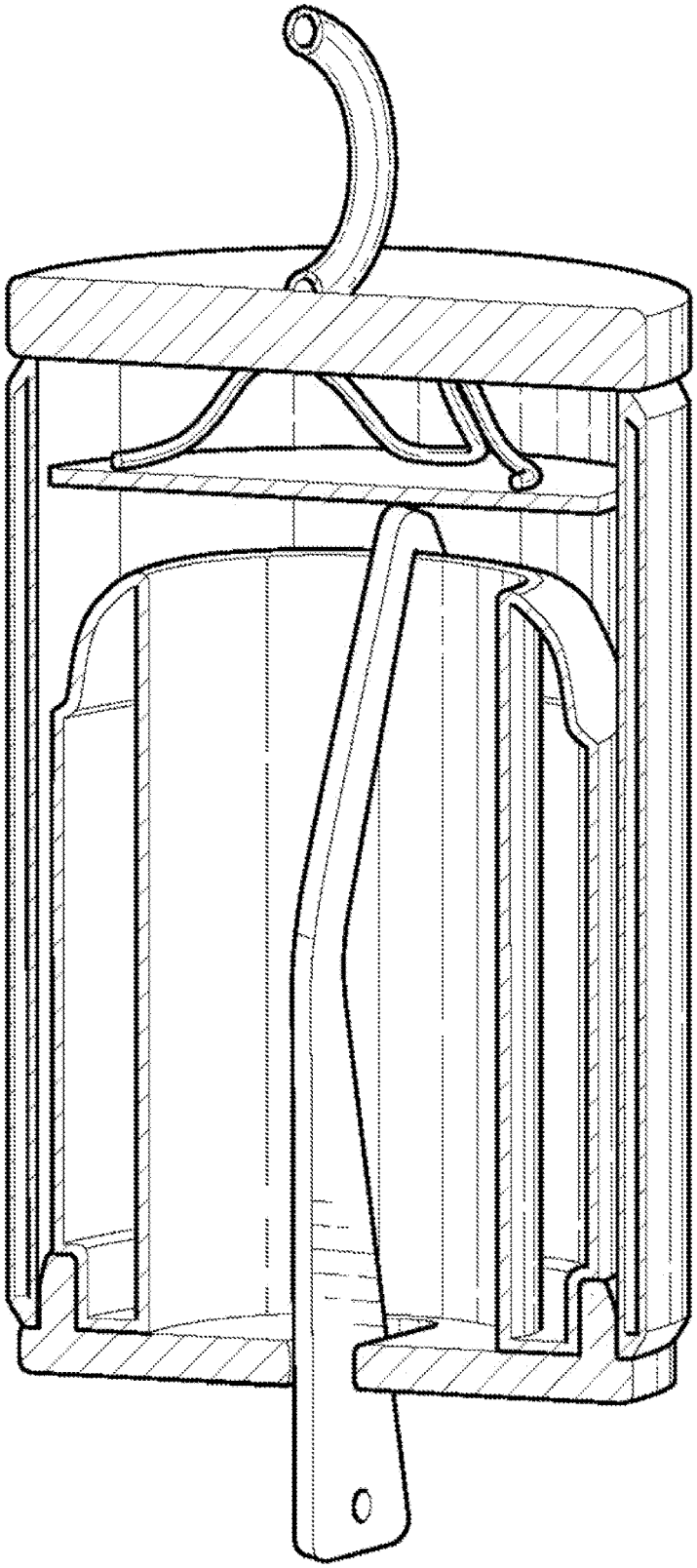
FIG. 4 illustrates a cut away view of the clasp of an example embodiment.

The hook 130 is flattened to be easily guided through the slotted end-cap 124 at the bottom of the outer tube 110 and inner tube 120. The hook 130 shank has a hole in the end as shown in FIGS. 2 and 3, creating the eye to accommodate a jump ring for attachment to a chain or strand with an option to attach a tail or tag to indicate the attachment point when concealed. The hook 130 has a bend that is rounded on the outside with an inside notch that matches the contour of the beveled edge 122 of the inner tube 120. The throat of the hook 130 is shortened to fit the space created by the bevel of the inner tube 120. The shaft of hook 130 is bent from 150 degrees to 170 degrees at a midway point. The midway bend of the shaft of hook 130 is configured with an angle corresponding to the length and inner diameter of the inner tube 120. The shaft of hook 130 is wider at a lower end, again configured with width corresponding to the length and inner diameter of the inner tube 120. The midway bend of the shaft of hook 130 is rounded and angled to provide a rocking motion for the hook 130. This shape and angle of the shaft of hook 130 places the hook 130 in the interior of inner tube 120 in a position flush to one side of the insertion point, thereby indicating a closed position. The shape, angle, and positioning of the hook 130 allows the user to easily understand which way to "rock" the hook 130 when pressing toward the inner plate 114 to release the hook 130. In a particular embodiment, the inner tube 120 with beveled edge 122 and outer tube 110 can be fabricated as a single component or piece depending on the manufacturing process.

In operation, the hook 130 is inserted into the slot of the slotted end-cap 124 at the bottom end of the outer tube 110 and inner tube 120 and pressed against the plate 114 within. This action compresses the spring 116 above the plate 114, which flattens the spring 116 to create enough space to allow a slight wiggling or tilting of the hook 130 into place over the beveled edge 122 of the inner tube 120. Releasing the pressure at this point pushes the hook down onto a lip created by the beveled edge 122 (e.g., see FIG. 4). The plate 114 and spring 116 provide enough downward tension to hold the hook 130 securely in place.

Because all the working parts of this clasp design are concealed within the outer tube 110 and inner tube 120 upon latching, the closed end of the clasp can be hidden within a bead, stone or pendant. The hook 130 can have a small tag or tail to indicate its placement without detracting from the accessory's overall visual appearance, while still allowing the wearer to easily find the connection and remove the piece. Although this tail is small, it may have enough space to display a logo or other brand mark of some sort.

The outer tube 110 may also be etched or molded in some way to add texture for simple arrangements. The entire clasp design can be made in a large variety of sizes to compensate for load. For some arrangements, the tail isn't necessary because the connection areas can be made to be readily apparent.

Figure 5:
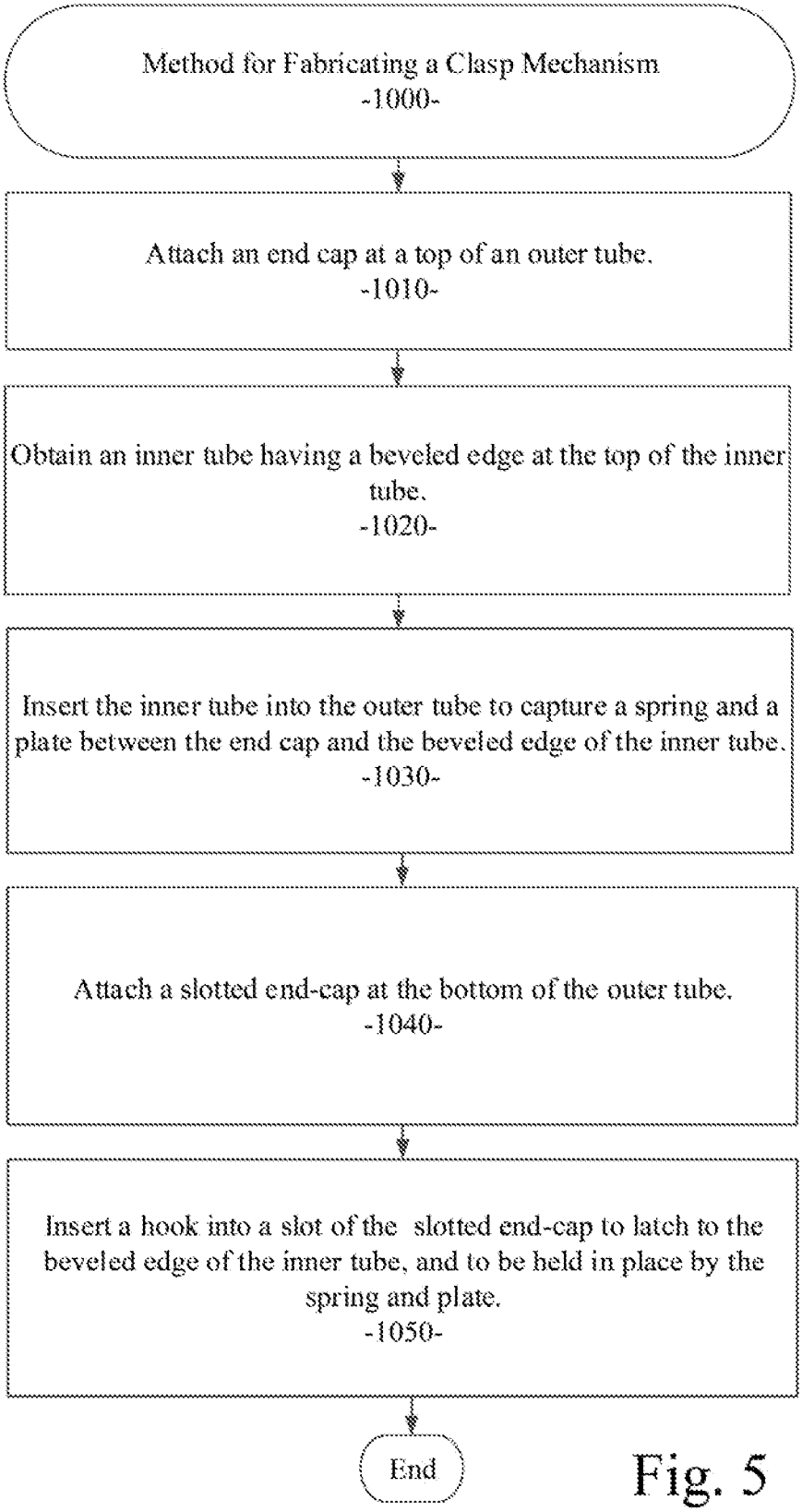
FIG. 5 illustrates a method of an example embodiment.

FIG. 5 illustrates a method of an example embodiment. The example embodiment can be configured to include a method 1000 for fabricating a clasp mechanism, the method comprising: attaching an end cap at a top of an outer tube (operation 1010); obtaining an inner tube having a beveled edge at the top of the inner tube (operation 1020); inserting the inner tube into the outer tube to capture a spring and a plate between the end cap and the beveled edge of the inner tube (operation 1030); attaching a slotted end-cap at the bottom of the outer tube (operation 1040); and inserting a hook into a slot of the slotted end-cap to latch to the beveled edge of the inner tube, and to be held in place by the spring and plate (operation 1050).

In standard necklaces, as it is designed currently, large rings can hold multiple jump rings to which other jump rings are connected for more permanent connectivity, with one or two strands using a spring ring for the versatility of configuration for the wearer. These detachable spring ring strands can be worn on their own, or they can be worn behind the neck to elongate the rest of the necklace. With my clasp, any strand or strands can be removed and worn separately or together in any configuration the wearer chooses. Any unused connections will simply appear as a decorative element rather than an empty ring. There are many design options with different large rings that hold a different number of strands, etc. A jewelry/accessory company can provide all of these options for truly customizable jewelry and costume jewelry. Necklaces, bracelets, earrings-all changeable to match the whim of the wearer.

In the various embodiments of the clasp as described above, the clasp can be used for a variety of applications for attaching items including at least the following:

- Phone and purse charms;
- Utensil hanging/organizing (kitchen or bath organization);
- Hair extensions;
- Curtain hanging loops/hoops;
- Plant/hummingbird/decor hangers;
- Eyeglass strap connectors;
- Soft binder loops; and
- Hanging things from ceilings (lamps generally).

In an alternative embodiment with a slightly different outer design with the inner parts shaped to fit, the alternative embodiment can be in the shape of a square when viewed from front and back and a long rectangle from the other four sides of the box-shaped clasp. In this configuration, the clasp can be used for at least the following applications:

- A child safety cabinet latch;
- Belt buckles, secure strap buckles as seen in luggage;
- A daily use (not sport) carabiner, such as for retaining a set of keys;
- Work badge attachment to lanyard;
- Dog collar buckle;
- A buckle for secure placement of an automobile organizer;
- A bungie cord replacement; and
- In a plastic form: product packaging as a replacement of zip-ties.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A clasp mechanism comprising:

an outer tube;

an end cap attached at a top of the outer tube;

an inner tube encompassed by the outer tube, the inner tube having a beveled edge at the top;

a spring and a plate captured between the end cap and the beveled edge of the inner tube;

a slotted end-cap at the bottom of the outer tube; and a hook configured for insertion into a slot of the slotted end-cap, to latch to the beveled edge of the inner tube, and to be held in place by the spring and plate.

2. The clasp mechanism of claim 1 wherein the clasp mechanism is fabricated from metal or plastic.

3. The clasp mechanism of claim 1 wherein the beveled edge of the inner tube is slanted downward from an interior of the inner tube toward an exterior of the inner tube.

4. The clasp mechanism of claim 3 wherein the beveled edge of the inner tube is slanted at an angle in the range of 35 degrees to 45 degrees.

5. The clasp mechanism of claim 1 wherein the spring is a four-legged, starfish-shaped spring.

6. The clasp mechanism of claim 1 wherein the plate is configured to apply pressure to hold the inserted hook in place against the beveled edge of the inner tube.

7. The clasp mechanism of claim 1 wherein the hook is flattened to facilitate insertion of the hook through the slot of the slotted end-cap at the bottom of the outer tube.

8. The clasp mechanism of claim 1 wherein the hook includes a hole in an end to facilitate attachment to a chain or strand.

9. The clasp mechanism of claim 1 wherein the hook includes a rounded bend and a notch with an angle configured to match an angle of a contour of the beveled edge of the inner tube.

10. The clasp mechanism of claim 1 wherein the inner tube with beveled edge and the outer tube are fabricated as a single component.

11. A method for fabricating a clasp mechanism, the method comprising:

attaching an end cap at a top of an outer tube;

obtaining an inner tube having a beveled edge at the top of the inner tube;

inserting the inner tube into the outer tube to capture a spring and a plate between the end cap and the beveled edge of the inner tube;

attaching a slotted end-cap at the bottom of the outer tube; and inserting a hook into a slot of the slotted end-cap to latch to the beveled edge of the inner tube, and to be held in place by the spring and plate.

12. The method of claim 11 wherein the clasp mechanism is fabricated from metal or plastic.

13. The method of claim 11 wherein the beveled edge of the inner tube is slanted downward from an interior of the inner tube toward an exterior of the inner tube.

14. The method of claim 13 wherein the beveled edge of the inner tube is slanted at an angle in the range of 35 degrees to 45 degrees.

15. The method of claim 11 wherein the spring is a four-legged, starfish-shaped spring.

16. The method of claim 11 wherein the plate is configured to apply pressure to hold the inserted hook in place against the beveled edge of the inner tube.

17. The method of claim 11 wherein the hook is flattened to facilitate insertion of the hook through the slot of the slotted end-cap at the bottom of the outer tube.

18. The method of claim 11 wherein the hook includes a hole in an end to facilitate attachment to a chain or strand.

19. The method of claim 11 wherein the hook includes a rounded bend and a notch with an angle configured to match an angle of a contour of the beveled edge of the inner tube.

20. The method of claim 11 wherein the inner tube with beveled edge and the outer tube are fabricated as a single component.

* * * * *